US008020727B2

(12) United States Patent
Herman et al.

(10) Patent No.: US 8,020,727 B2
(45) Date of Patent: Sep. 20, 2011

(54) POWERED DISPENSING TOOL AND METHOD FOR CONTROLLING SAME

(75) Inventors: Timm Herman, Ellicotville, NY (US); Brent M. Findlay, Belfast, NY (US); Michael R. Wheeley, San Diego, CA (US); Mark Kastner, New Berlin, WI (US)

(73) Assignee: Meritool LLC, Ellicottville, NY (US)

( * ) Notice: Subject to any disclaimer, the term of this patent is extended or adjusted under 35 U.S.C. 154(b) by 0 days.

(21) Appl. No.: 11/918,689

(22) PCT Filed: Dec. 29, 2006

(86) PCT No.: PCT/US2006/049513

§ 371 (c)(1),
(2), (4) Date: Oct. 17, 2007

(87) PCT Pub. No.: WO2008/048319

PCT Pub. Date: Apr. 24, 2008

(65) Prior Publication Data

US 2010/0001017 A1 Jan. 7, 2010

Related U.S. Application Data

(60) Provisional application No. 60/852,492, filed on Oct. 18, 2006.

(51) Int. Cl.
*B05C 17/01* (2006.01)

(52) U.S. Cl. ..... 222/1; 222/63; 222/333

(58) Field of Classification Search ..... 222/1, 63, 222/333, 52, 326, 327, 386, 391; 318/280, 318/283; 388/937, 930

See application file for complete search history.

(56) References Cited

U.S. PATENT DOCUMENTS

| | | | | |
|---|---|---|---|---|
| 4,132,330 | A | | 1/1979 | Rauscher et al. |
| 4,260,076 | A | | 4/1981 | Bergman |
| 4,421,251 | A | | 12/1983 | Namdari et al. |
| 4,583,934 | A | | 4/1986 | Hata et al. |
| 4,920,782 | A | | 5/1990 | Hellwig |
| 4,953,755 | A | | 9/1990 | Dennison |
| 4,986,454 | A | | 1/1991 | Riley |
| 5,058,768 | A | | 10/1991 | Lichfield |
| 5,246,143 | A | | 9/1993 | Cherfane |
| 5,246,144 | A | | 9/1993 | Cathcart, Sr. et al. |
| 5,248,061 | A | * | 9/1993 | Weiselfish et al. ..... 222/63 |
| 5,295,614 | A | | 3/1994 | Chang |
| 5,341,958 | A | | 8/1994 | Bayat et al. |

(Continued)

OTHER PUBLICATIONS

Gurit-Essex Global Excellence BETASEAL quickline Applicator Operating Instructions (4 pages).

(Continued)

*Primary Examiner* — Kevin P Shaver
*Assistant Examiner* — Donnell Long
(74) *Attorney, Agent, or Firm* — Tarolli, Sundheim, Covell & Tummino LLP

(57) ABSTRACT

An apparatus and method for monitoring and controlling motor current during a dispensing of material from a dispensing tool (10) is provided, including a method for measuring the motor current of the dispensing tool during operation through a motor controller (U2). The method further includes sending a feedback signal from the motor controller (U2) relating to the measured motor current to an input of a microcontroller (U1) that is adapted to a dispensing tool (10). The feedback signal is compared to a prescribed threshold and the motor current is conditioned based on the comparing of the feedback signal to the prescribed threshold.

24 Claims, 6 Drawing Sheets

U.S. PATENT DOCUMENTS

| | | | | |
|---|---|---|---|---|
| 5,441,175 | A | | 8/1995 | Jacobsen et al. |
| 5,556,009 | A | | 9/1996 | Motzko |
| 5,592,733 | A | | 1/1997 | Wareham |
| 5,775,539 | A | | 7/1998 | Bates et al. |
| 5,816,455 | A | | 10/1998 | Alpers et al. |
| 5,829,636 | A | | 11/1998 | Vuong et al. |
| 5,909,830 | A | * | 6/1999 | Bates et al. ..... 222/327 |
| 5,913,370 | A | * | 6/1999 | Chapelle et al. ..... 173/169 |
| 5,918,685 | A | * | 7/1999 | Ulbrich et al. ..... 173/4 |
| 6,013,991 | A | * | 1/2000 | Philipp ..... 318/139 |
| 6,050,450 | A | | 4/2000 | Gardos |
| 6,062,428 | A | | 5/2000 | Callahan |
| 6,089,407 | A | | 7/2000 | Gardos |
| 6,123,235 | A | | 9/2000 | Hsu |
| 6,392,373 | B1 | | 5/2002 | Glasgow et al. |
| 6,401,978 | B1 | | 6/2002 | Young |
| 6,460,481 | B1 | | 10/2002 | Young |
| 6,540,113 | B2 | | 4/2003 | Gardos |
| 6,823,134 | B2 | | 11/2004 | Glasgow et al. |
| 6,889,872 | B2 | * | 5/2005 | Herman et al. ..... 222/82 |
| 6,923,177 | B2 | | 9/2005 | Scott et al. |
| 7,116,071 | B2 | | 10/2006 | Glasgow et al. |
| 7,249,695 | B2 | * | 7/2007 | Shew ..... 222/333 |
| 7,282,880 | B2 | | 10/2007 | Glasgow et al. |
| 7,495,407 | B2 | * | 2/2009 | Huang et al. ..... 318/599 |
| 7,523,843 | B2 | * | 4/2009 | Shew et al. ..... 222/262 |
| 7,690,530 | B2 | * | 4/2010 | Schneider et al. ..... 222/63 |

OTHER PUBLICATIONS

Publication Entitled "EZ-mix® HI Cordless Hand-Held Dispenser User Guide", DTIC Dispensing Technologies International Corporation; Copyright 2000; 12 sheets.

* cited by examiner

POWERED DISPENSING TOOL AND METHOD FOR CONTROLLING SAME

CROSS-REFERENCES TO RELATED APPLICATIONS

The present application claims priority to International Application No. PCT/US2006/049513 entitled "POWERED DISPENSING TOOL AND METHOD FOR CONTROLLING SAME", having an international filing date of Dec. 29, 2006 and U.S. Provisional Patent Application No. 60/852,492 entitled "POWERED DISPENSING TOOL AND METHOD FOR CONTROLLING SAME", filed Oct. 18, 2006. The entirety of the aforementioned patent applications are incorporated herein by reference for all purposes.

TECHNICAL FIELD

The present invention relates to a power dispensing tool and method for controlling, and is particularly directed to a power dispensing tool and its controller that employs various methods of controlling the dispensing of material from the tool.

SUMMARY OF THE INVENTION

In accordance with one exemplary embodiment of the present invention is a method for monitoring and controlling motor current during a dispensing of material from a dispensing tool comprising measuring the motor current of the dispensing tool during the operation through a motor controller and sending a feedback signal from the motor controller relating to the measured motor current to an input of a microcontroller that is adapted to the dispensing tool. The method further comprises comparing the feedback signal to a prescribed threshold and conditioning the motor current based on the comparing of the feedback signal to the prescribed threshold.

In accordance with another exemplary embodiment of the present invention is method for starting a motor for dispensing material from a dispensing tool comprising reading a selected motor demand manually chosen by an operator of the dispensing tool and comparing the selected motor demand to a first motor demand value over a prescribed period of time. The method further comprises comparing the selected motor demand with the first motor demand over the prescribed period of time to form a demand rate and conditioning the motor current based on the demand rate such that if the demand rate is greater than a threshold over a preset period of time, a preset rise in motor current is applied to the motor of the dispensing tool.

In accordance with a further exemplary embodiment of the present invention is a method for preventing material from excreting from a dispensing tool at the end of operation comprising reading motor information received by a microcontroller from a motor controller adapted to a dispensing tool and analyzing the motor information by comparing the information to a preset parameter. The method further comprises monitoring motor current for a cease in operation and conditioning the motor current based on the monitoring detecting a cease in operation, the conditioning resulting from the analyzing of the motor information and comparing the motor information to the preset parameter.

In accordance with yet another exemplary embodiment of the present invention is a method for conserving power from a power supply adapted in a dispensing tool comprising detecting a cease of motor operation in a dispensing tool by sending a signal from a motor controller to a microcontroller that is adapted to the dispensing tool and delaying a sensing operation for a prescribed period of time from the detecting a cease in motor operation. The method further comprises measuring the power supply voltage over a predetermined period of time by the microcontroller, comparing the power supply voltage to a prescribed threshold within the microcontroller, and conditioning the current supply to the motor controller and a speed potentiometer based on the comparing.

In accordance with yet another further exemplary embodiment of the present invention is a material dispensing gun comprising a body connected to a dispensing portion, handle portion, and a driver portion. The driver portion is driven by a motor connected to a motor controller and microcontroller. The microcontroller and motor are connected to a power supply. The motor is controlled by the microcontroller, motor controller, a trigger, trigger switch, and at least one potentiometer.

BRIEF DESCRIPTION OF THE DRAWINGS

The foregoing and other features and advantages of the present invention will become apparent to one skilled in the art to which the present invention relates upon consideration of the following description of the invention with reference to the accompanying drawings, in which.

DETAILED DESCRIPTION OF THE PREFERRED EMBODIMENTS

Figure 1:
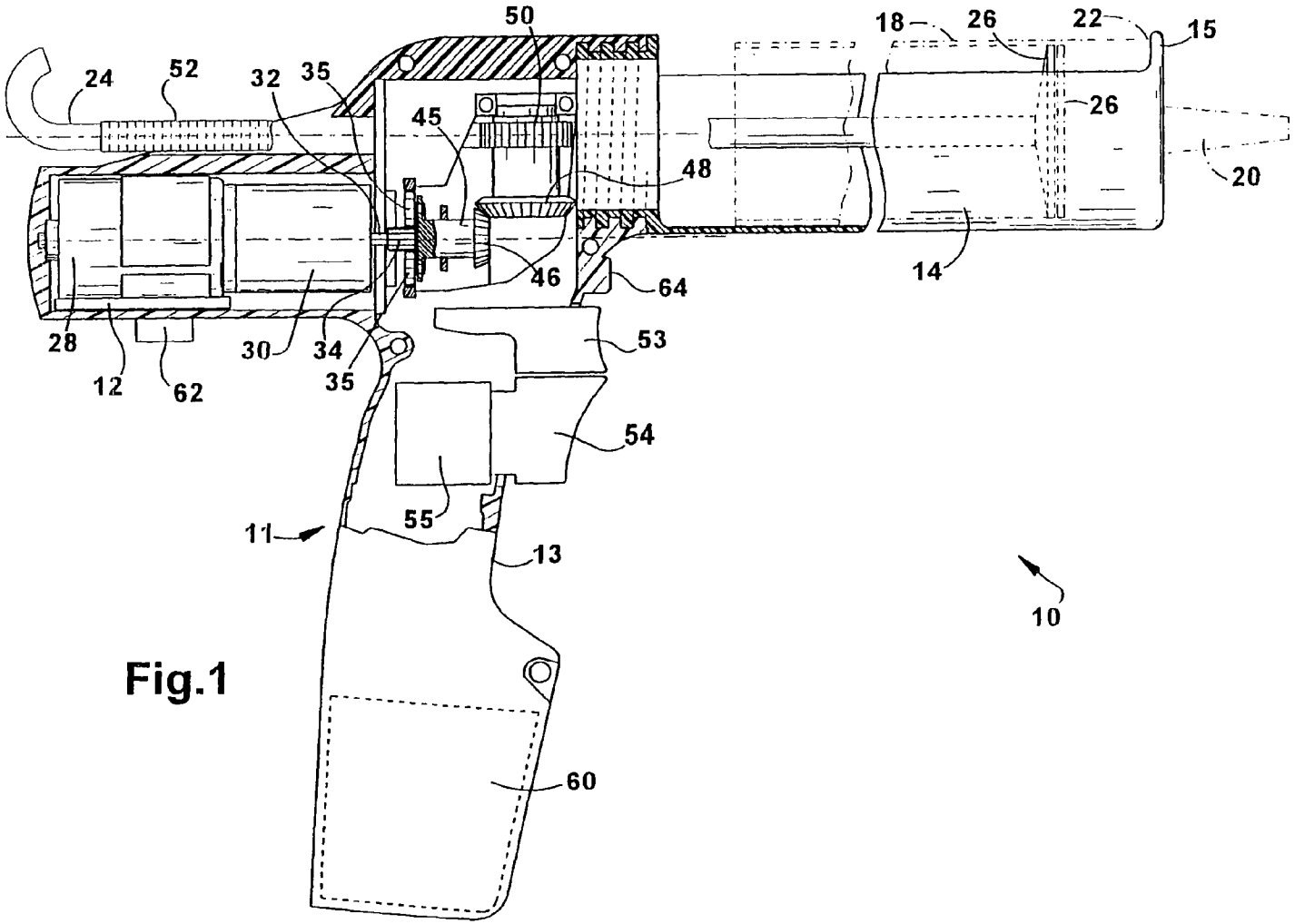
FIG. 1 is a side elevation view of a dispensing tool, the tool being equipped with a controller of the current disclosure.

FIG. 1 illustrates a dispensing tool 10 housing a controller 12 of the current disclosure. The dispensing tool 10 includes a handle section 11 having a handle 13 and a cartridge support section 14. The support section 14 includes an end wall 15 having a nozzle receiving slot (not shown). A cartridge containing material to be dispensed is shown in phantom at 18. The cartridge includes a dispensing nozzle 20 that extends though the slot while an end of the cartridge 22 abuts the end wall 15.

The design of the dispensing tool 10 herein is for a caulk gun/material dispensing tool. It should however be appreciated that the gun could dispense other materials such as adhesives without departing from the spirit and scope of the claimed invention.

An elongated rod 24 extends axially into the cartridge support section 14. A piston 26 is connected to a forward end of the rod such that axial movement of the rod will cause comparable axial movement of the piston. An electric motor 28 is mounted in a rearward portion of the handle 13. The motor is connected to gearing within a gear box 30 that is a first portion of a gear train. The gear box has an output shaft 32. The shaft 32 drives additional gears making up a second portion of the gear train, namely 34, 35, 45, 46, and 48. The gear train drives a pinion 50, which in turn drives a rack 52 formed on the rod 24.

Actuating a clutch trigger 53 allows a trigger 54 that is moveably located to the handle section 11 to slide into contact with a motor trigger housing 55. A battery pack 60 is connected either directly or indirectly to the controller 12, trigger 54, and the motor 28. Actuation of the trigger 54 enables the motor 28. Operation of the motor 28 advances the rod 24 for dispensing of material in the cartridge 18.

Located near the controller 12 is a communication port 62 for allowing various peripherals to communicate with the controller 12. The communication port is a serial data transmission port, but could include other types of data transmission connections, for example a parallel port or universal serial bus ("USB") type connection.

Figure 2:
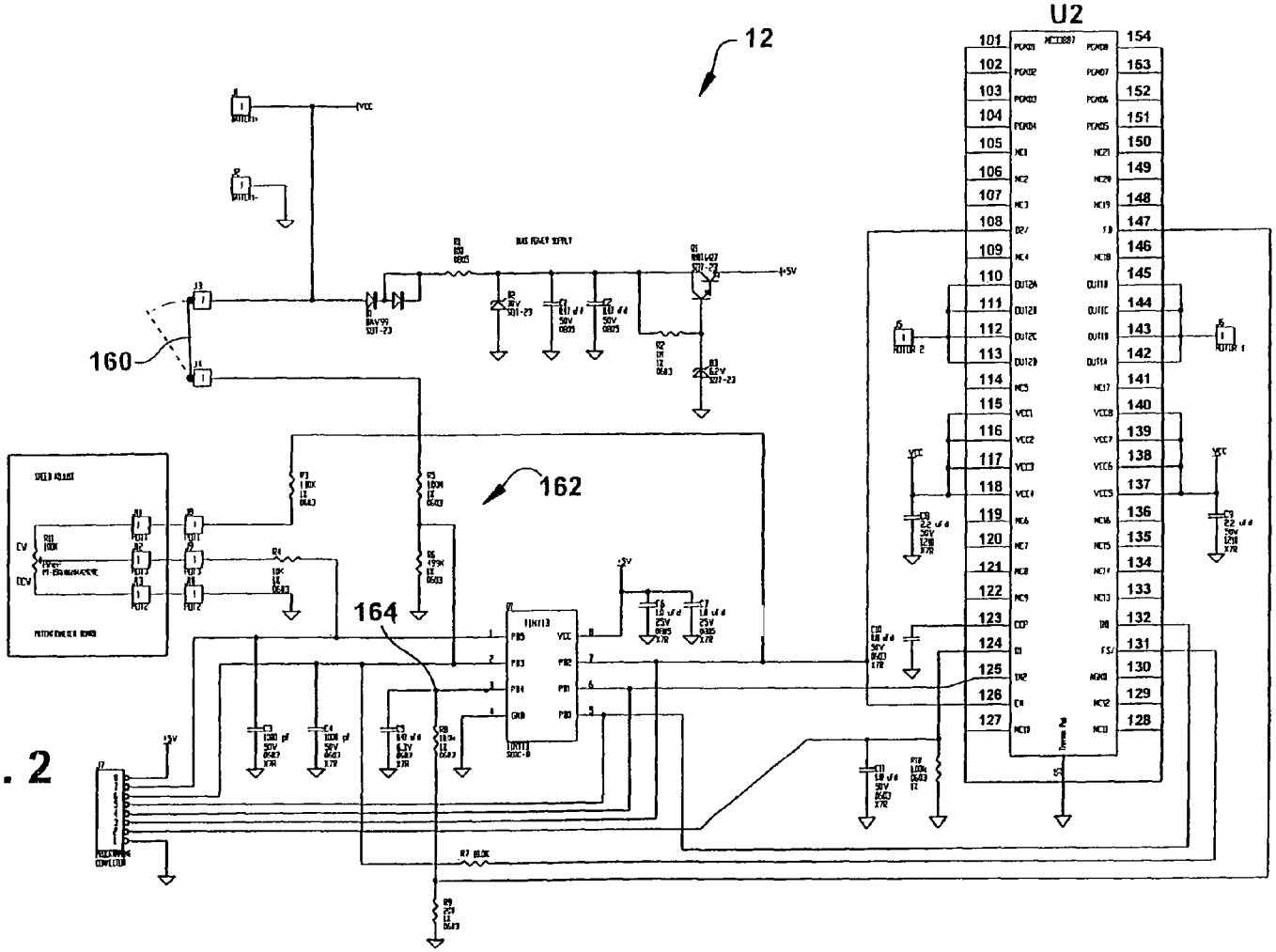
FIG. 2 is a detailed circuit diagram of the controller of FIG. 1.

Referring to FIG. 2, a detailed circuit diagram of the controller 12, in accordance with one example embodiment is shown. When the battery pack 60 is installed in the tool 10, DC power is supplied to terminal J1 (+) and J2 (−). Full battery voltage is connected directly to a motor controller U2, which controls the power (amount and direction of current) applied to the tool's motor 28. A small current flows into the circuit's bias supply, through diode D1 and resistor R1 to zener diode D2 and capacitors C1 and C2. Diode D1 prevents damage to transistor Q1 and downstream circuitry in the event of an inadvertently reverse connected battery. Diode D1 also prevents back-flow of current out of the bias supply in the event of transient voltage decrease on the incoming power. Zener diode D2 limits the incoming voltage to a level to transistor Q1, and prevents incoming momentary voltage pulses from damaging transistor Q1 and downstream circuitry; resistor R1 provides upstream impedance that allows zener D1 to perform this function without being damaged. Resistor R1 and capacitors C1 and C2 also form a low pass filter and energy reservoir, to filter out high-frequency components that might otherwise be present and to act as a source of energy for Q1 and its downstream circuitry.

Transistor Q1, resistor R2, and zener diode D3 form a series voltage regulator that provides approximately 5 volts to the downstream circuitry that includes a microcontroller U1. An integrated voltage regulator could also be used for this function, particularly if a more precise output voltage is desired. The solution used herein can be achieved at a relatively low cost since a precisely regulated bias supply voltage is not required in this design. This regulator design consumes very little current when the tool is not in use, which enhances battery life.

The motor controller U2 used in the illustrated example embodiment is a MC33887 manufactured by Freescale Semiconductor (of Austin, Tex., USA). Other suitable motor controllers could be used that are available from Freescale and other manufacturers. The motor controller U2 contains internally many of the components needed to drive a reversible DC motor. These internal components include a full bridge (composed of 4 metal-oxide semiconductor field-effect transistor(s) ("MOSFET")), MOSFET gate drivers, a charge pump based bias supply for the gate drivers, control logic, a feedback output that is proportional to the load current, and fault sensing circuitry. It should be appreciated by those skilled in the art that the specific functions performed by the motor controller U2 can be external from the motor controller U2 and accomplished using discrete circuitry. Those functions could be combined into one Application Specific Integrated Circuit ("ASIC"). The fault sensing circuitry includes over temperature, short circuit, and under voltage sensing circuitry. When a fault is sensed, an output driving the motor 28 is disabled, and the existence of a fault is indicated on an output for that purpose. Thus, this fault sensing circuitry enhances the reliability of the controller U2 and the dispensing tool 10 that uses it.

The motor controller U2 is controlled by the microcontroller U1. In the illustrated example embodiment a Tiny13 microcontroller manufactured by Atmel was used. However, other types of microcontrollers from Atmel or from one of the many other microcontroller manufacturers could have also been used as the microcontroller U1.

One purpose of the microcontroller U1 is to control the switching elements (MOSFETs) within the motor controller U2, and thus control the direction of current and magnitude of the current flowing to the dispensing motor 28. This allows the motor's speed and direction of motion to be controlled. It also allows control over the motor's torque.

When the trigger 54 on the dispensing tool 10 is engaged by an operator, a trigger switch 160 is advanced to a closed position between terminals J3 and J4 on controller 12. The microcontroller U1 receives two inputs from the user: the on/off signal from the trigger switch 160 and a speed signal from a speed potentiometer R11. The speed potentiometer R11 can be manually adjusted by the dispensing tool user through a dial 64 shown in FIG. 1. When the trigger switch 160 is in an open position (shown in phantom in FIG. 2), the microcontroller U1 receives a logic low signal at pin 2 (port PB3). When the trigger switch 160 is in the closed position, the battery voltage is applied to a voltage divider 162 composed of R5 and R6, and a logic high signal is applied to the microcontroller U1 at pin 2 (port PB3). This signal alerts the microcontroller that the trigger 54 has been actuated. Note that only a very small control current flows through the trigger switch in this design; this allows a much less expensive trigger switch to be used (as compared to typical power tools wherein the motor current flows through the trigger switch).

The speed potentiometer R11 receives its power from the microcontroller's pin 7 (port PB2). This allows the microcontroller U1 to remove power from the potentiometer R11 when it is not in use, which minimizes battery current draw when the tool is not in use. When active, the potentiometer R11 produces an output voltage on its wiper that is proportional to the logic supply voltage and to the potentiometer's setting. This voltage is applied to the microcontroller's pin 1 (port PB5). The microcontroller U1 monitors the voltage on pin 1 with an internal analog-to-digital converter ("ADC") to determine the potentiometer's setting and the user's desired dispensing speed. The voltage that is monitored is compared to the microcontroller's supply voltage to determine the ADC's reading; this is referred to as a ratiometric operation. Thus, the absolute value of the microcontroller's supply voltage does not affect the value monitored from the potentiometer R11, reducing the need for a tightly controlled bias supply voltage.

In addition to controlling power to the potentiometer R11, the microcontroller's pin 7 (port PB2) also turns the motor controller U2 off and on via the motor controller's enable pin 126. When the enable pin 126 is driven with a logic high signal, the motor controller U2 is active and ready to receive logic inputs and to drive the motor 28 according to those logic inputs. When the enable pin 126 is driven with a logic low signal, the motor controller is powered down and consumes very little power. Thus, the microcontroller U1 is able to control the power consumption of the motor controller U2, and as a result allows very little battery drain when the tool 10 is not in use.

Pin 5 (port PB0) and pin 6 (port PB1) of the microcontroller U1 control the two sides of the MOSFET bridge within the motor controller U2 by communicating to the motor controller through pins 132 and 125, respectively (provided the motor controller U2 is enabled by the enable signal previously described). In normal operation, one of these two signals is driven to a continuous logic high state while the other is driven with a pulse-width modulated (PWM) signal that is internally generated within the microcontroller U1. The duty cycle of the PWM signal is set primarily by the potentiometer R11 setting, and determines the effective voltage seen by the motor 28. This effective voltage sets the motor's speed, and also limits the maximum torque that it can develop.

Motor Current Monitoring and Control

The dispensing tool develops a relatively slow linear motion that is used to dispense caulk, adhesives, or other materials from cartridges. This slow linear dispensing speed is produced by reducing the motor speed through several stages of the gear train 30, 34, 35, 45, 46, and 48 followed by the pinion 50 driving the rack 52. In normal operation, the force developed by the rack 52 is within an acceptable range (that will not affect the reliability of the tool). However, if the rack encounters an obstacle that causes the motor speed to slow dramatically or stall completely, the amount of force developed by the rack will increase substantially (for a fixed motor drive voltage). This increased force may be enough to cause damage to the tool's gear reduction assembly, the rack, or the cartridge holder (for the dispensed material). Therefore, it is necessary to monitor this force and to quickly take corrective action should the force become too high.

The force developed by the rack is proportional to the torque developed by the motor (due to the fixed gear reduction). The motor torque is proportional to the motor current. Therefore, monitoring motor current provides a very good indication of the rack force.

In one example embodiment, the controller 12 is designed to monitor the motor current in the dispensing tool 10 during operation. The motor controller U2 has a feedback output communicated from pin 147 that produces a very small current that is proportional to the motor current. This feedback current is passed through resistor R9 to develop a voltage, which is then filtered by the low pass filter 164 composed of R8 and C5. This filtered signal is then measured by the ADC within the microcontroller U1. As long as the motor current measurement feedback signal is within acceptable bounds, no further action is taken. However, if the feedback signal increases above a predetermined threshold, the microcontroller U1 will reduce the duty cycle of the PWM signal to reduce the force developed by the rack 52. If the feedback signal decreases below a predetermined threshold, the microcontroller U1 will increase the duty cycle of the PWM signal to increase the force developed by the rack 52.

If the motor current measurement feedback signal rises at a rate faster than a pre-established rate-of-increase limit, the microcontroller U1 algorithm will cease to drive the motor 28 (and rack 52) in the forward direction, and will instead drive it in the reverse direction for a short interval, and then shut the tool off. This condition may occur for instance when the plunger 26 reaches the end of travel or if a tool jam occurs; further attempt to drive the tool forward under this condition may cause tool damage.

Figure 3:
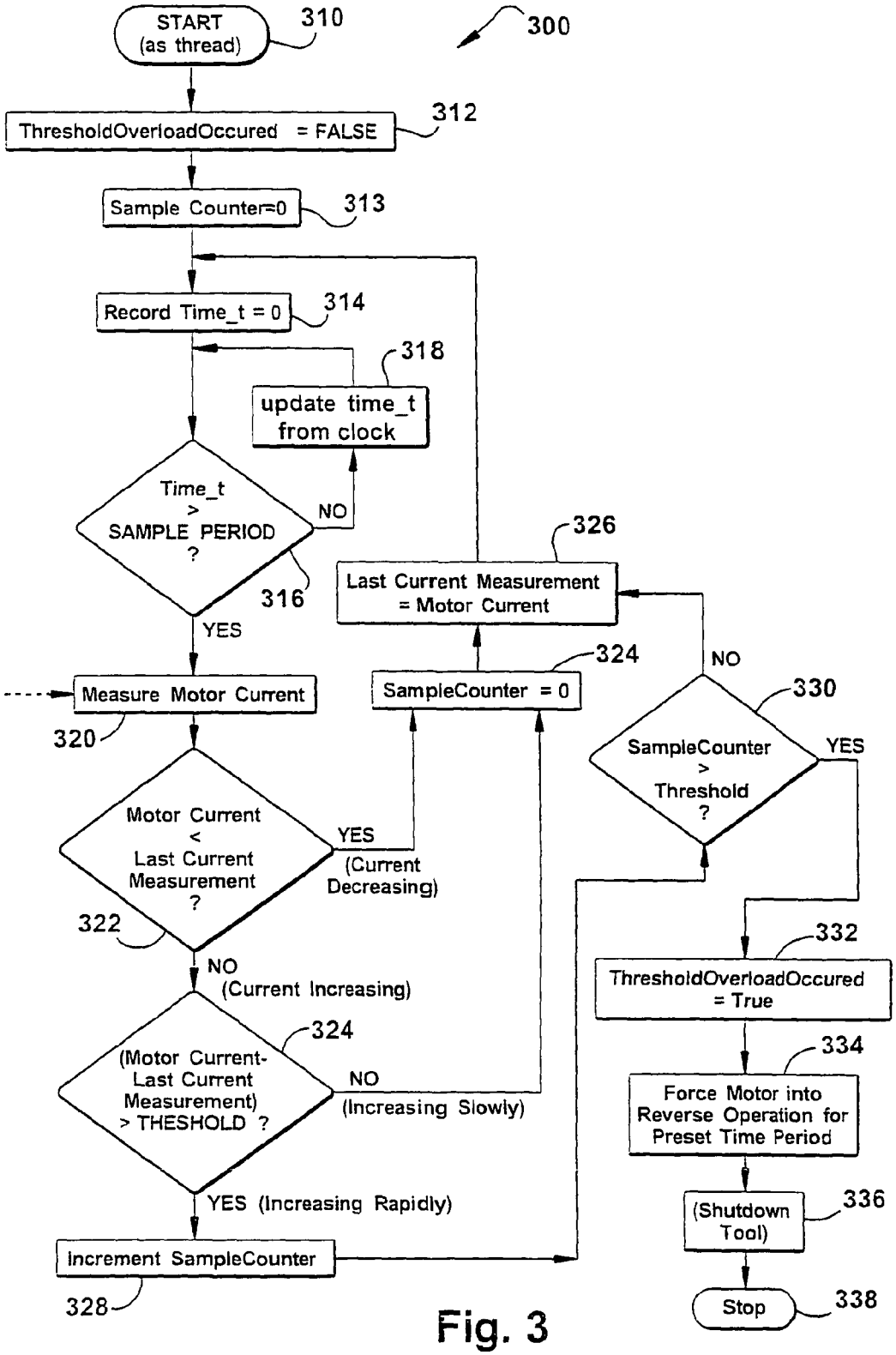
FIG. 3 is a flow diagram depicting a method for controlling a dispensing tool in accordance with an example control process of the present invention.

Referring to FIG. 3, a method 300 for monitoring motor current for obstacle avoidance in accordance with one example embodiment of the present invention is shown. The method 300 demonstrates a process and provides a symbolic representation of computer readable media that can be used to monitor the motor current for obstacle avoidance. The media can be integrated into firmware that is embedded within the controller 12 or flash Read Only Memory ("ROM") or as a binary image file that can be programmed by a user. Flash memory allows the memory to be programmed after the microcontroller is installed in the circuit. Further, flash memory can be re-programmed many times. This combination allows the tool's characteristics to be changed when the tool is assembled or in the field. Flash memory can also allow the dispensing tool control circuit 12 to be used for other applications unrelated to dispensing caulk and adhesives (for example, other tool types). A connector represented by J7 is the connector used to program the microcontroller in place on the circuit board, which is connected to external peripherals via communication port 62 on the dispensing tool 10. Further the method 300 could represent the flow diagram relating to an application specific analog circuit designed to monitor the motor current for obstacle avoidance. It is to be further understood that the following methodology can be implemented in hardware (e.g., a computer or a computer network), software (e.g., as executable instructions running on one or more computer systems), or any combination of hardware and software.

The monitoring process starts at 310 and the algorithm is initialized. A false condition is written at 312 which records that a threshold overload has not occurred. A sample counter is initialized at 313. A record time is initialized at 314. A comparison occurs between the record time 314 and a sample period at 316. If the sample period is less than the time record the record time is updated from a system clock at 318. If the comparison 316 reveals a sample time period that is greater than the record time, the motor current of dispensing tool 10 is measured at 320. The measured motor current is then compared to a last current measurement at 322. If the motor current is less than the last current measurement, the motor current is decreasing and an initialization of a sample counter occurs at 324. As a result, the measured motor current measured at 320 is assigned the value of the last current measurement at 326. It will be appreciated by those skilled in the art that on the first iteration of this control loop no previous motor current information is available and in this special case allowance must be made to prevent a false rapidly increasing motor current indication.

Alternatively, if the motor current measured at 320 is greater than the last current measurement, the current is increasing. During increasing current conditions, a delta current is compared against a prescribed current threshold at 324. The delta current is the measured motor current at 320 less the last current measurement. If the delta current is not greater than the prescribed threshold, the current is increasing slowly and the sample counter is reset at 324 and the last current measurement is set equal to the measured motor current at 326. An indication that the current is increasing rapidly is given when the delta current in 324 is greater than the prescribed threshold, which results in an incrementing of the sample counter at 328.

The incremented sample counter at 328 is compared to a threshold at 330. If the sample counter is less than a prescribed threshold, the last current measurement is set equal to the motor current at 326 and another sample is performed. Alternatively, if the sample counter at 328 is found greater than the prescribed threshold at 330, a threshold overload is detected at 332. As a result of the threshold overload, the motor 28 is forced into reverse operation for a preset period of time at 334 followed by a shut down of the dispensing tool 10 at 336 until the tool is completely stopped at 338.

According to another example embodiment, the controller 12 is designed to regulate the forward motion motor current so that the user can control a steady flow of dispensed material from the dispensing tool 10. The flow of viscous material is directly proportional to motor current (excluding frictional losses). As such, directly regulating the motor current relating to user demand allows for an even flow of material. In particular, the direct current motor 28 can be controlled by regulating the phase angle (duty cycle) and voltage of the motor input as represented in the closed-loop controller 400 of FIG. 4. The regulating of the phase angle can be achieved by controlling the input to a motor controller 418.

The closed-loop controller 400 can be achieved by programming the controller 12 through, for example firmware embedded within the controller, or flash ROM, or binary image file. The closed-loop controller 400 represented in FIG. 4 could also be constructed in hardware, for example, by creating an application specific integrated circuit or with the use of integrated circuit operational amplifiers. The process for regulating forward motion motor current by the closed-loop controller 400 depicted in FIG. 4 includes a summing point 410, which evaluates the user demand less the current measurement 412 received from a negative feedback loop. A timed interval 414 allows an output signal from the summing point 410 to be received by function $f(x)$ block 416. The purpose of function $f(x)$ is to integrate the output signals that are received at regular intervals t and control the phase angle by predetermined limits, thereby adjusting the motor controller 418 to produce a desired output to the motor 420 of the dispensing tool 10.

Figure 4:
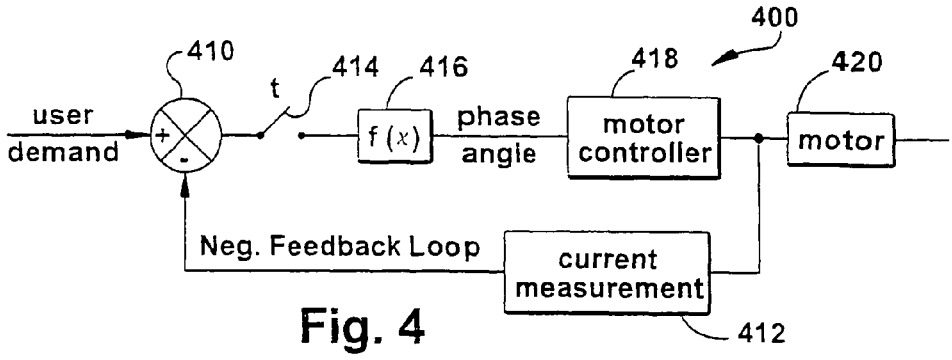
FIG. 4 is a control diagram depicting a method of controlling motor current in a dispensing tool in accordance with an example control process of the present invention.

The motor controller U2 of FIG. 2 is operatively represented by the motor controller block 418 of FIG. 4. The motor controller U2 is controlled by an output of microcontroller U1 at pin 5 (port PB0) and pin 6 (port PB1), which connect to the motor controller U2 at pins 132 and 125 respectively. To control the motor in the forward direction the microcontroller U1 output pin 7 (port PB2) is pulled high to enable the motor controller U2, microcontroller pin 6 (port PB1) is held high and microcontroller U1 output pin 5 (port PB0) is pulse-width modulated (PWM) with reverse logic. A maximum PWM output (continuous logic low on the PWMing pin) causes motor controller U2 to turn full on in the forward direction and drive the motor at full output, whereas a minimal PWM output (continuous logic high on the PWMing pin) at microcontroller U1 output pin 5 (port PB0) causes a minimum output at the motor.

To reverse the motor, microcontroller U1 output pin 7 (port PB2) is held high to enable the motor controller U2, microcontroller U1 output pin 5 (port PB0) is held high and microcontroller pin 6 (port PB1) is pulse-width modulated with reverse logic. A maximum PWM output (continuous logic low on the PWMing pin) at microcontroller pin 6 (port PB1) results in a maximum output in the reverse direction to the motor, whereas a minimum PWM (continuous logic high on the PWMing pin) on microcontroller pin 6 (port PB1) causes a minimum output in the reverse direction at the motor.

It should be appreciated by those skilled in the art that positive logic, rather than the inverted logic described above, could also be used to control the motor, with no change in the resulting motor/tool characteristics. In that case, one of the two control outputs from the microcontroller (pin 5/port PB0 or pin 6/port PB1) would be held continuously low (resulting in the corresponding side of the motor winding being held continuously low), while the other logic output would be driven with the PWM signal. In this case, the high state of the PWMing output would actively drive the motor, and a full on condition would exist when the PWM output was continuously high.

It should be appreciated by those skilled in the art that the motor controller U2 as represented by block 418 in FIG. 4 is a closed-loop motor controller and that the transfer function $f(x)$ in block 416 could be different forms, for example an integrating function.

Soft Start

When the trigger switch 160 is actuated, the microcontroller U1 wakes up from its sleep mode, and then begins to drive the motor 28 (via motor controller U2). Rather than immediately drive it at the speed indicated by the speed potentiometer R11 (also represented by 64 in FIG. 1), a soft start feature of the dispensing tool 10 allows the speed to be ramped up from zero speed to the desired speed over a short interval (typically less than one second). This soft start feature gradually increases the motor voltage, and in doing so reduces the peak motor current that would occur during the startup interval by allowing the motor to accelerate and develop counter-emf before the full drive signal is applied. It also reduces the peak torque applied to the tool, and allows for smoother dispensing of material. Further, the soft start feature increases the tool life expectancy and reduces tool wear.

Figure 5:
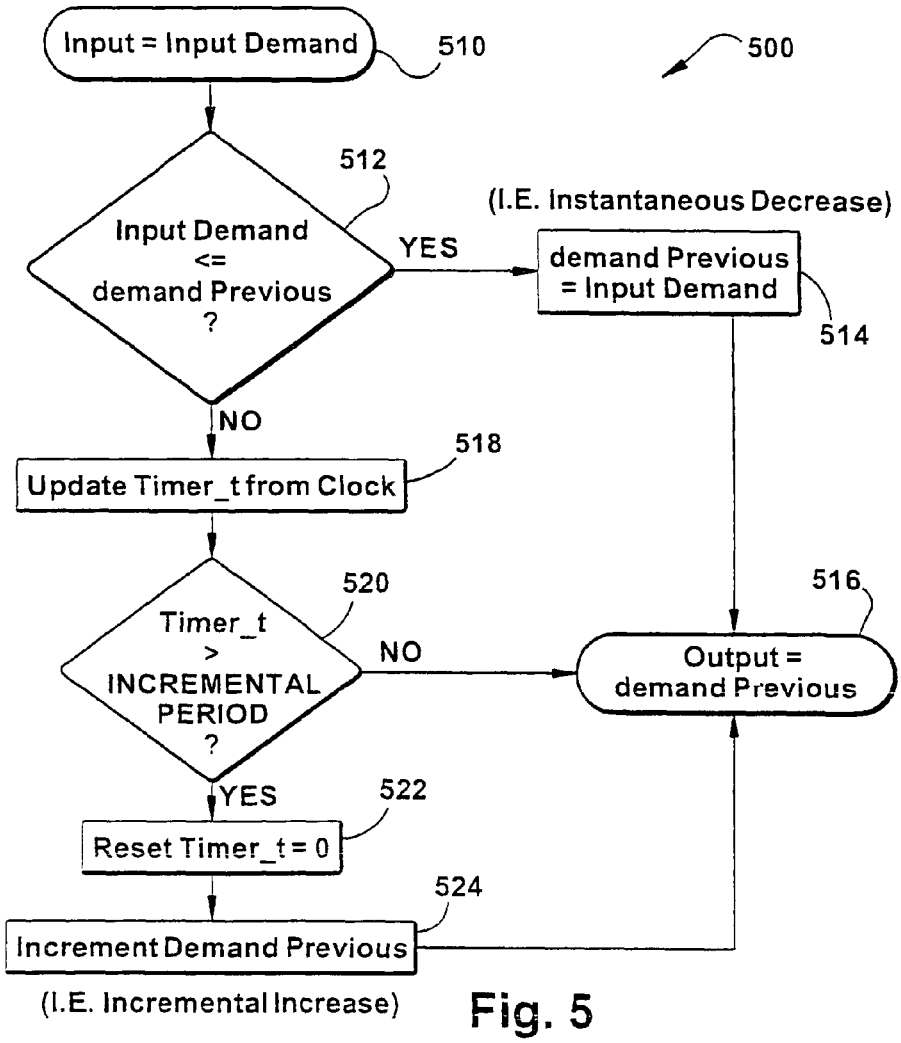
FIG. 5 is a flow diagram depicting a method of initiating motor startup in a dispensing tool in accordance with an example control process of the present invention.

The soft start feature is achieved by a soft start algorithm 500 represented by the process steps depicted in a flow chart of FIG. 5. It should be appreciated by those skilled in the art that the algorithm depicted in FIG. 5 could be accomplished by either hardware or software programming techniques or a combination of the two without departing from the spirit and scope of the claimed invention.

The process of FIG. 5 is initiated by setting an input value equal to an input demand signal at 510. The input demand signal received is based on the requirements of the user of the dispensing gun 10 by control of the potentiometer 64. A comparison of the input demand signal and a previous demand value occurs at 512. If the input demand signal is less than the previous demand value, the input demand signal is assigned as the previous demand value at 514, which is subsequently assigned as an output value at 516. If the input demand signal is greater than the previous demand value a timer from a clock is initiated at 518. A timed value from the clock is compared to an incremental period at 520. If the timed value is less than the incremental period the previous demand value is assigned as the output value at 516. Alternatively, if the timed value is greater than the incremental period, the timed value is initialized or set equal to zero at 522 and the demand previous value is incremented by a prescribed amount at 524, which is then assigned as the output value at 516.

Figure 6:
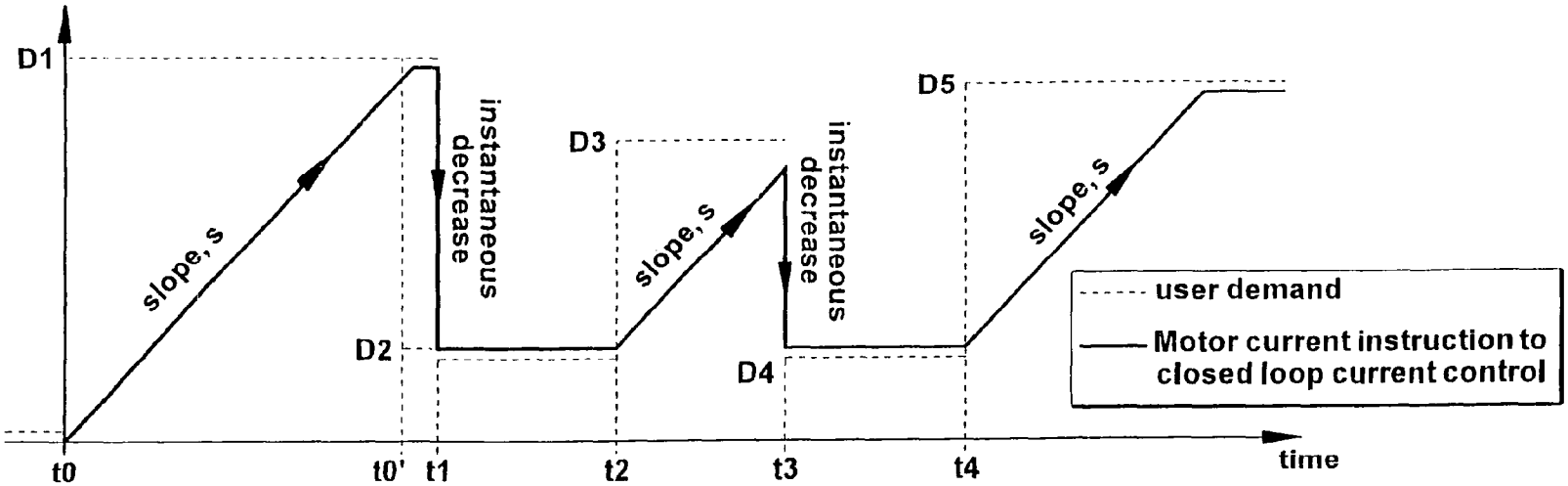
FIG. 6 is a graphical illustration of the motor current supply operation based on a control algorithm following the method of FIG. 5.
Figure 9:
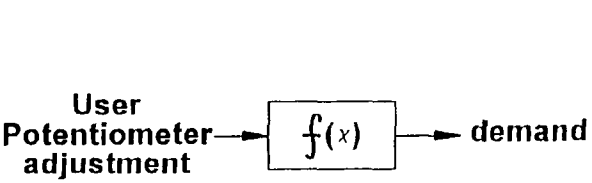
FIG. 9 is a control diagram depicting an example embodiment of a central process for regulating the speed rate of change in a dispensing tool in accordance with the present invention.

Implementing the soft start process shown in the example embodiment of FIG. 5 limits the rate of increase of user demand to the closed-loop controller input 410 in FIG. 4, which controls the motor speed. FIG. 6 graphically illustrates the soft start algorithm feature where time to occurs when the operator pulls the trigger 54, generating a demand level D1. The soft start algorithm of the dispensing tool demand rises with a prescribed slope S. It will be appreciated by those skilled in the art that the slope S is a direct function of the INCREMENTAL_PERIOD shown in 520 of FIG. 5. In FIG. 6, the dispensing tool 10 reaches actual user demand level at time $t_0'$. At time $t_1$, the user adjusts potentiometer 64 to a demand level D2. The output of the soft start algorithm instantaneously allows the demand output to fall to the level D2. At time $t_2$ the user adjusts potentiometer 64 to produce a demand level D3. The soft start algorithm 500 again limits the increase rate to the input of the closed loop motor controller and thus limiting the demand as illustrated by the slope S. At time $t_3$ the user adjusts the potentiometer 64 allowing the demand to fall to a level D4. The output to the motor controller failed to reach the demand level D3, but remains unaffected and instantaneously decreases the demand current to the motor controller to the demand level D4.

In an alternative example embodiment, the reduction in the user demand level can similarly produce a gradual descent in the demand output. More specifically, the demand could be reduced at a prescribed slope if a sudden or instantaneous decrease is found undesirable to the dispensing tool 10.

In another alternative embodiment the potentiometer R11, 64 is integrated into the trigger 54 such that the operator can modify the demand by pulling the trigger to differing positions.

In yet another alternative embodiment two potentiometers are provided, with the user demand being a function of both potentiometers. For example, one dial control might provide a coarse adjustment while another integrated into the trigger switch 54 provides a fine control. Alternately, the function derived from the two potentiometers might be mathematic in nature, such as the product or sum of the two potentiometer settings. If the function is a product of the two potentiometers, the dial potentiometer effectively becomes a slope adjustment for the potentiometer in the trigger, setting the amount that the user demand increases with each incremental increase in trigger depression.

Variable Auto-reverse

It is desirable to minimize or eliminate dispensing material from excreting from the dispensing tool 10 after operation has ceased. Such condition can be achieved by providing a mechanism for reversing the motor momentarily after the user releases the trigger 54. By reversing the motor the internal pressure in the dispensing material is reduced and prevents excess material from being dispensed.

Figure 7:
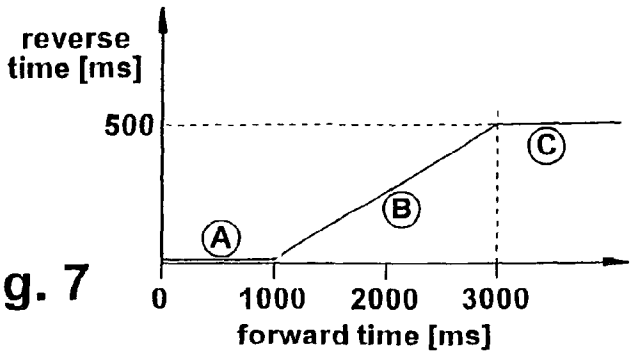
FIG. 7 is a graphical illustration of a timed auto-reverse feature as a function of forward time for a dispensing tool being controlled in accordance with an example control process of the present invention.

In one example embodiment, the duration of the auto-reverse feature is a function of the time that the material was dispensed in a forward direction. For example, FIG. 7 depicts a graphical illustration having three different auto-reverse times contingent on the magnitude of the motor forward time. If the forward time is ranges between 0 ms and 1000 ms the auto-reverse time is zero, represented graphically by section A in FIG. 7. If the forward time is between 1001 ms and 3000 ms, the auto-reverse time is calculated based on Equation (1) below and represented graphically by section B in FIG. 7:

$$\text{auto-reverse time [ms]} = (\text{forward time [ms]} - 1000\ \text{[ms]})/4 \qquad \text{Equation (1)}$$

If the forward time is greater than 3000 ms the auto reverse time is equal to 500 ms, which is represented graphically by section C in FIG. 7.

During operation, the total time that the dispensing tool 10 was advancing in the forward direction was recorded. When the user releases the trigger 54 ending the forward cycle, an analysis is performed for calculating the duration of the auto-reverse cycle. The duration of the auto-reverse cycle is a function of the total forward time duration as illustration in FIG. 7. In another example embodiment, the speed of the auto-reverse cycle is equal to the forward speed just prior to the time when the user released the trigger 54. In another example embodiment, the duration of the reverse operation is a function of the measured current in the motor at the instant the trigger 54 is released, and is a function of the motor torque and pressure in the dispensed material. In section A of FIG. 7, the pressure in the dispensing tool is not significant enough to require an auto-reverse operation. In section C, the maximum auto-reverse cycle occurs. It should be appreciated by those skilled in the art that a desirable maximum auto-reverse cycle exists that would prevent material from seeping from the dispensing tool, but not retract so far as to delay the material dispensing in the subsequent forward cycle. It should further be appreciated by those skilled in the art that the auto-reverse durations may vary base on the viscosity of the material being dispensed and changes to the auto-reverse times could be made without departing from the spirit and scope of the claimed invention.

In another example embodiment, the controller 12 would integrate the forward cycle speed and time to deduce the total forward motion travel and calculate the auto-reverse duration based on the total calculated. In yet another example embodiment, the auto-reverse duration is a function of the dispensing material's viscosity. The thinner or lower the material's viscosity the longer auto-reverse time in order to prevent dripping. The microcontroller U1 calculates the material's viscosity by comparing the duty cycle of the drive signal applied to the resulting motor current. By calculating this value, the auto-reverse time can be adjusted to a more suitable time for the material being dispensed. The time should be enough to prevent material from dripping from the end of the nozzle 20 following dispensing, but controlled in distance and speed in order to minimize the delay in dispensing once the trigger 54 is again actuated.

Referring to FIG. 2, the timed auto-reverse feature in one embodiment is operated by the controller 12. If the trigger switch 160 is closed for a very short interval (represented by section A in FIG. 7) before being re-opened, the microcontroller U1 directs the motor controller U2 to drive the motor 28 for a like time, and then simply stops. However, if the trigger switch 160 is closed for a longer interval and then opened, the microcontroller U1 will direct the motor controller U2 to first stop driving the motor 28 in the forward direction, and then momentarily drive it in the reverse direction for a short time (represented by sections B and C in FIG. 7) before turning the motor off. This auto-reverse feature relieves the pressure on the dispensed material, and in so doing reduces or eliminates material dripping from the cartridge once dispensing has stopped.

Memory Type

The microcontroller U1 contains non-volatile memory types, one of which can be modified by the microcontroller during execution. The microcontroller U1 can write valuable information into the memory, and this information can later be read out using the same connections J7, 62 as are used to install the program memory in the microcontroller U1. Thus, the microcontroller U1 can record diagnostic information such as run time, number of cycles, average run speed, average trigger-actuated duration, etc. This information can be useful for a number of purposes, including but not limited to diagnosing the cause of tool failures, learning about typical applications, verifying in-warrantee status, and tracking run time and number of cycles for various applications including rental.

Battery Conservation

When the trigger 54 is released, the microcontroller U1 puts the motor controller U2 and the potentiometer R11 into a low-current shutdown state and puts itself into a low-power sleep mode, such that the overall power consumption of the tool 10 is very low. The reduced current shutdown state allows the battery drain of the unused tool to be extremely low and prevents the discharge of, and damage to the battery pack 60 when the tool is not in use. The shutdown-state battery drain of the circuit is typically far less than the self-discharge current of the battery pack itself. While in this shutdown state, the microcontroller U1 continues to monitor pin 2 (port PB3) that is connected to the trigger switch 54, 160, such that it can wake up itself and the other components when the trigger 54, 160 is actuated. Thus, a heavy duty trigger switch or relay to control the full motor current is not required, resulting in a reduction in cost for the motor control circuit.

Figure 8:
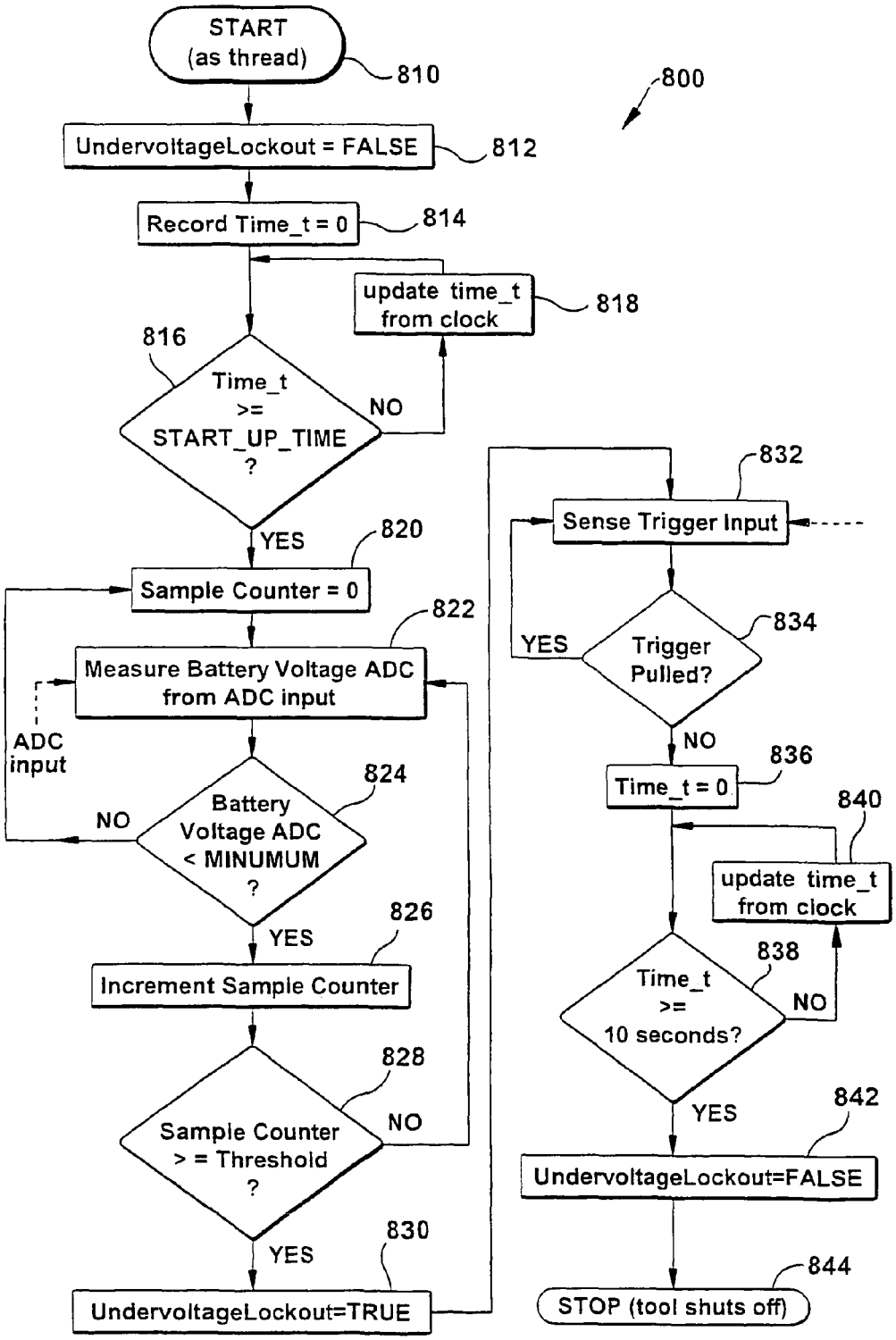
FIG. 8 is a flow diagram depicting an example embodiment of a battery monitoring and protection feature control process for a dispensing tool in accordance with the present invention.

The operation of the dispensing tool can be prevented from operating or locked out if the controller 12 senses that the battery voltage is below a prescribed threshold. FIG. 8 depicts a flow chart of the lockout process 800 in accordance with one example embodiment. The lockout process is initiated at 810 and initializes the algorithm at 812 by recording into memory that a lockout has not occurred. A record time t is initialized or set to zero at 814, which begins a timing period. The sensing of an under voltage condition is delayed slightly after the dispensing tool 10 has been started because the tool use may provide an artificially low battery voltage. A comparison is made at 816 such that if the time t is less than a start up time, time t will be updated from a system clock at 818. If the time t is greater than the start up time the sensing begins and a sample counter is initialized or set equal to zero at 820. The battery voltage is then measured from an analog-to-digital converter input at 822. The ADC input is located on the microcontroller U1 input pin 2 (port PB3) of FIG. 2. The measured battery voltage is compared to a predetermined minimum value at 824. If the measured battery voltage is greater than the minimum, the sample counter at 820 is reset to zero. Alternatively, if the measured battery voltage is less than the predetermined minimum value, the sample counter is incremented at 826. A comparison occurs at 828, evaluating whether the sample counter is greater than a prescribed threshold. If the threshold is greater, the battery voltage is re-measured at 822. If the sample counter is greater than or equal to the threshold, an under voltage lockout is present at 830. The presence of the under voltage lockout causes a global flag in the controller 12 such that the tool enters a reverse cycle and then shuts-off. The step of sensing whether the trigger 54 is engaged occurs at 832. If the trigger is not enabled, time t is reset to zero at 836. If the time t is greater than a prescribed period of time, for example ten seconds a comparison at 838 determines that the under-voltage lockout is false at 842. Differently stated, the global flag remains at a lockout state and the tool is powered off by the operator's release of the trigger 54 and remains off for an additional prescribed period of time, in this example embodiment ten seconds, preventing the operator from pulling the trigger 54 and causing a forward cycle to begin.

From the description of the invention, those skilled in the art will perceive improvements, changes and modifications. In addition to the dispensing tool being a battery powered gun/material dispensing tool, one skilled in the art will appreciate that the dispensing tool is equally suited for dispensing other materials without departing from the spirit and scope of the claimed invention. For example, the dispensing tool could be used for dispensing adhesives. Similarly, while the dispensing tool and controller herein is powered from a battery pack, it could also be powered from other sources without departing form the spirit and scope of the claimed invention. Such improvements, changes, and modifications within the skill of the art are intended to be covered by the appended claims.

We claim:

1. A method for monitoring and controlling motor current during a dispensing of material from a dispensing tool having a microcontroller that controls operation of said dispensing tool comprising:

measuring the motor current of a motor coupled to a motor controller during dispensing of material by the dispensing tool;

sending a feedback signal from the motor controller relating to the measured motor current to an input of the microcontroller;

storing a prescribed threshold related to motor current in the microcontroller;

comparing the feedback signal to said prescribed threshold;

reversing the motor direction if said comparing indicates a feedback signal greater than the prescribed threshold; and evaluating the feedback signal's rate of change in motor current over a prescribed period of time, comparing the rate of change in motor current to a prescribed rate of change threshold, and reversing the motor direction if the rate of change in motor current exceeds the prescribed rate of change.

2. The method of claim 1, wherein the motor direction is reversed for a preset period of time when said comparing produces a feedback signal value that is greater than the prescribed threshold.

3. The method of claim 2, additionally comprising stopping the dispensing tool's motor after the preset period of time when said comparing produces a feedback signal value that is greater than the prescribed threshold.

4. The method of claim 1 further comprising regulating the dispensing tool's motor current for a steady flow of dispensed material by regulating a phase angle and voltage of the motor input.

5. The method of claim 1, further providing an on/off switch coupled with a speed control potentiometer for setting the prescribed threshold.

6. The method of claim 1, further providing a variable speed trigger coupled with a speed control potentiometer.

7. A method for adjusting a motor operation to control dispensing of material from a dispensing tool comprising:

determining a selected motor demand value manually chosen by an operator of the dispensing tool;

comparing the selected motor demand value to a first motor demand value;

determining an updated demand value based on the comparison between the selected motor demand and said first motor demand value; and if the updated demand value is greater than a threshold , controlling an increase in motor current to the motor of the dispensing tool by delaying an increase in motor current by a delay period to achieve a controlled rise in motor current; and if the updated demand value is less than the first demand value, applying a motor current to the motor to achieve the updated demand value.

8. The method for starting a motor for dispensing material from a dispensing tool of claim 7 wherein said conditioning the motor current based on the demand rate further comprises regulating a rate of increase in the operator's demand in a closed-loop controller input that controls the motor speed.

9. The method for starting a motor for dispensing material from a dispensing tool of claim 7 wherein said conditioning the motor current is for a predetermine period of time.

10. A method for monitoring and controlling current through a motor for dispensing of material from a dispensing tool comprising:

providing a microcontroller that executes a control program for monitoring operation of the dispensing tool and coupling a control output from the microcontroller to a motor controller for energizing the motor with a controlled energization signal;

sensing the motor current of the dispensing tool during the operation through the motor controller;

sending a feedback signal from the motor controller relating to the sensed motor current to an input of the microcontroller so the control program of said microcontroller can compare the feedback signal to a prescribed threshold;

conditioning the motor current based on said comparing of the feedback signal to the prescribed threshold; and regulating the dispensing tool's motor current for a controlled flow of dispensed material by regulating an energization voltage coupled to a motor input.

11. The method of claim 10, wherein said control program evaluates the feedback signal's rate of change in motor current over a prescribed period of time and compares the rate of change in motor current to a rate of change threshold.

12. The method of claim 10, wherein said conditioning includes reversing the motor direction for a preset period of time when a feedback signal value is greater than the prescribed threshold.

13. The method of claim 10, wherein said conditioning further includes stopping the dispensing tool's motor when a feedback signal value is greater than the prescribed threshold.

14. The method of claim 10 further wherein conditioning the motor current based on said feedback signal comprises forming a demand rate and if the demand rate is greater than a previous demand rate over a preset period of time, applying a preset rise in motor current to the motor of the dispensing tool.

15. The method of claim 14 wherein said conditioning the motor current based on the demand rate further comprises regulating a rate of increase in response to an operator's demand input in a closed-loop controller output to the motor controller that controls the motor speed.

16. The method of claim 10 wherein said conditioning the motor current occurs for a predetermined period of time.

17. The method of claim 10 wherein the regulating the energization voltage is performed by controlling a phase angle of the voltage applied to the motor.

18. The method of claim 10 wherein the feedback signal input to the microcontroller is proportional to the sensed motor current and further wherein the microcontroller performs an analog to digital conversion of the feedback signal before comparing to the prescribed threshold.

19. A method for monitoring and controlling motor current during a dispensing of material from a dispensing tool having a microcontroller that controls operation of said dispensing tool comprising:

measuring the motor current of a motor coupled to a motor controller during dispensing of material by the dispensing tool;

sending a feedback signal from the motor controller relating to the measured motor current to an input of the microcontroller;

evaluating the feedback signal's rate of change in motor current over a prescribed period of time and comparing the rate of change in motor current to a rate of change threshold; and adjusting the motor current based on the comparison between the feedback signals rate of change and said rate of change threshold.

20. The method of claim 19 wherein said comparing produces a feedback signal value that rises at a rate faster than a pre-established rate-of-increase limit, said conditioning of the motor current results in a termination of the advancement of the motor and a rack coupled to the motor that moves dispensing material in a forward direction and then drives said rack in a reverse direction opposite said forward direction.

21. A method for monitoring and controlling current through a motor for dispensing of material from a dispensing tool comprising:

providing a microcontroller that executes a control program for monitoring operation of the dispensing tool and sending a control output from the microcontroller to a motor controller coupled to the motor for energizing the motor with a pulse width modulated signal;

sensing the motor current of the dispensing tool during the operation through said motor controller;

sending a feedback signal from the motor controller relating to the sensed motor current to an input of the microcontroller so that the control program can compare the feedback signal to a prescribed threshold related to a desired flow of dispensed material;

conditioning the motor current based on said comparing of the feedback signal to the prescribed threshold; and regulating the dispensing tool's motor current by regulating the pulse width modulated voltage input to a motor input.

22. The method of claim 21 wherein said conditioning includes reducing the duty cycle of the PWM voltage resulting in a reduction in the force used to dispense material from the dispensing tool when a feedback signal value is greater than the prescribed threshold.

23. The method of claim 21 wherein said conditioning includes increasing the duty cycle of the PWM voltage resulting in an increase in the force used to dispense material from the dispensing tool when a feedback signal value is lower than the prescribed threshold.

24. The method of claim 21 wherein the feedback signal input to the microcontroller is proportional to the sensed motor current and further wherein the microcontroller performs an analog to digital conversion of the feedback signal before comparing to the prescribed threshold.

* * * * *